US008561559B2

(12) United States Patent
Okuyama

(10) Patent No.: US 8,561,559 B2
(45) Date of Patent: Oct. 22, 2013

(54) SEWING SYSTEM, MULTI-NEEDLE SEWING MACHINE, STORAGE DEVICE AND COMPUTER READABLE MEDIUM

(75) Inventor: Tsuneo Okuyama, Mie-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 807 days.

(21) Appl. No.: 12/801,400

(22) Filed: Jun. 7, 2010

(65) Prior Publication Data

US 2010/0313803 A1 Dec. 16, 2010

(30) Foreign Application Priority Data

Jun. 10, 2009 (JP) ..... 2009-139104

(51) Int. Cl.
*D05B 19/12* (2006.01)
*D05B 55/10* (2006.01)
*D05C 5/04* (2006.01)

(52) U.S. Cl.
USPC ..... 112/102.5; 112/470.04; 112/163; 700/138

(58) Field of Classification Search
USPC ..... 112/98, 103, 470.01, 470.02, 470.04, 112/470.06, 163, 475.17, 220; 700/17, 136, 700/138
See application file for complete search history.

(56) References Cited

U.S. PATENT DOCUMENTS 4,932,342 A * 6/1990 Hisatake et al. ..... 112/103
5,297,020 A * 3/1994 Sergio ..... 700/17
5,392,724 A 2/1995 Kurono et al.
5,904,109 A * 5/1999 Asano ..... 112/102.5
5,921,194 A * 7/1999 Komuro et al. ..... 112/470.01
7,055,443 B2 * 6/2006 Goto et al. ..... 112/102.5
7,252,044 B2 * 8/2007 Lee ..... 112/102.5
7,503,271 B2 * 3/2009 Hayakawa ..... 112/470.01
8,096,247 B2 * 1/2012 Monroe et al. ..... 112/80.43
8,170,708 B2 * 5/2012 Goldman et al. ..... 700/138
8,180,475 B2 * 5/2012 Taguchi et al. ..... 700/138
8,335,584 B2 * 12/2012 Yamada ..... 700/138
2008/0223275 A1 9/2008 Kishi et al.

FOREIGN PATENT DOCUMENTS

JP A-6-304372 11/1994
JP A-2001-137580 5/2001
JP A-2001-259268 9/2001
JP A-2003-93770 4/2003
JP A-2004-129947 4/2004
JP A-2008-220619 9/2008
JP A-2009-22400 2/2009

* cited by examiner

OTHER PUBLICATIONS

Japanese Office Action dated Apr. 19, 2011 issued in Japanese Patent Application No. 2009-139104 (with translation).

*Primary Examiner* — Ismael Izaguirre
(74) *Attorney, Agent, or Firm* — Oliff & Berridge, PLC

(57) ABSTRACT

A sewing system that forms an embroidery pattern on the workpiece cloth by co-operating a sewing mechanism and a transfer mechanism using a count of thread colors determined by a count of thread color data found to match thread color data by a verifier. By removing a storage device attached to one of the plurality of multi-needle sewing machines and attaching the removed storage device to other one or more multi-needle sewing machines, unsewn portions of the embroidery pattern at each of the other one or more multi-needle sewing machines are sewn by reading the progress information by a data reader, verifying whether or not the thread color data contained in the progress information read by the data reader matches thread spool color data of other one or more multi-needle sewing machines and executing a sewing operation based on the verification.

12 Claims, 9 Drawing Sheets

| EMBROIDERY PATTERN DATA | |
|---|---|
| THREAD COLOR 1 | PINK |
| | Xa0, Ya0 |
| | Xa1, Ya1 |
| | Xa2, Ya2 |
| | ⋮ |
| | XaN, YaN |
| THREAD COLOR 2 | YELLOW GREEN |
| | Xb0, Yb0 |
| | Xb1, Yb1 |
| | Xb2, Yb2 |
| | ⋮ |
| | XbN, YbN |
| THREAD COLOR 3 | GREEN |
| | Xc0, Yc0 |
| | Xc1, Yc1 |
| | Xc2, Yc2 |
| | ⋮ |
| | XcN, YcN |
| ⋮ | ⋮ |
| THREAD COLOR 12 | RED |
| | Xl0, Yl0 |
| | Xl1, Yl1 |
| | Xl2, Yl2 |
| | ⋮ |
| | XlN, YlN |

FIG. 4

| NEEDLE-BAR NO. | THREAD COLOR |
|---|---|
| 1 | PINK |
| 2 | YELLOW GREEN |
| 3 | GREEN |
| 4 | GOLD |
| 5 | YELLOW |
| 6 | BLACK |

FIG. 6A

| NEEDLE-BAR NO. | THREAD COLOR |
|---|---|
| 1 | BLUE |
| 2 | AQUA BLUE |
| 3 | SKY BLUE |
| 4 | BROWN |
| 5 | PURPLE |
| 6 | RED |

FIG. 6B

SEWING SYSTEM, MULTI-NEEDLE SEWING MACHINE, STORAGE DEVICE AND COMPUTER READABLE MEDIUM

CROSS-REFERENCE TO RELATED APPLICATION

This application is based upon and claims the benefit of priority from the prior Japanese Patent Application 2009-139104, filed on, Jun. 10, 2009, the entire contents of which are incorporated herein by reference.

FIELD

The present disclosure relates to a sewing system provided with a storage device that stores embroidery pattern data containing multiple thread color data, a multi-needle sewing machine, a storage device, and a computer readable medium.

BACKGROUND

The so called multi-needle sewing machines have been typically used to form embroidery patterns on a workpiece cloth with multiple thread colors. The multi-needle sewing machine is provided with multiple needle bars each having a sewing needle attached to its lower end. A sewing mechanism, including but not limited to the needle bars, and a transfer mechanism that transfers an embroidery frame for holding a workpiece cloth co-operate to execute a sewing operation with a desired thread color. The multi-needle sewing machine generates embroidery pattern data prior to the execution of the sewing operation using its internal embroidery data generator or a separate embroidery data generator.

The multi-needle sewing machine transfers the embroidery pattern data generated by the embroidery pattern generator to other one or more sewing machines to provide a sewing system that allows sewing operation to be executed by multiple multi-needle sewing machines. To elaborate, in one exemplary configuration, a sewing system is provided that centrally manages the distributed embroidery pattern data through a host computer connected to a plurality of multi-needle sewing machines. Under such sewing system, the embroidery pattern data is edited as to its selection of thread color, etc., at the host computer and the edited embroidery pattern data is thereafter transmitted to the intended client multi-needle sewing machine for subsequent execution of sewing operation at each of the multi-needle sewing machines.

Further, some variations of the above described sewing systems are configured by interconnecting two or more multi-needle sewing machines with a communication cable while assigning one of the multi-needle sewing machines, or a first automatic sewing machine, the task of converting the embroidery pattern data. Under this sewing system, the first automatic sewing machine transmits its own embroidery pattern to a second automatic sewing machine. Thus, the sewing operation is executed at both the first and the second automatic sewing machines based on the converted or edited embroidery pattern data.

The former sewing system often employs an off-the-shelf computer for the host computer, and thus, requires a high level of computer expertise on the part of the user as well as a costly investment in acquiring a computer which does not have any sewing features. The later sewing system, on the other hand, eliminates the need of the host computer. However, the later sewing system requires a dedicated computer processing program to co-operate the two or more sewing machines and communication cables for interconnecting the two or more sewing machines.

To address such problems, a third type of sewing system is known that is configured by a separate embroidery data generator provided independently of the multi-needle sewing machine(s) and a pair of a first and second tag reader/writers provided at the multi-needle sewing machine and the embroidery data generator respectively. Under this sewing system, the embroidery pattern data generated by the embroidery data generator is written on a wireless tag provided on the workpiece cloth by the first tag reader/writer. Then the multi-needle sewing machine performs the sewing operation based on the embroidery pattern data of the wireless tag read by the second tag reader/writer. Further, the multi-needle sewing machine is configured such that when the embroidery sewing machine operation is interrupted, progress status data indicating the progress status of the sewing operation at the point of interruption is written on the wireless tag by the second tag reader/writer. The first and second tag reader/writers allow wireless communication between the nodes and the wireless tags to eliminate the earlier described communication cables.

However, this sewing system has a downside of having to go through a troublesome task of attaching the wireless tag to each individual workpiece cloth prior to the embroidery sewing operation and removing the wireless tags after completing the embroidery sewing operation. Moreover, the system is disadvantageous in terms of cost because it requires dedicated accessories such as tag reader/writers for establishing a wireless communication with the wireless tags.

Still further, some of the embroidery patterns may require multiple thread colors that exceed the color variation available in a single multi-needle sewing machine. In sewing such embroidery patterns, the sewing operation must be interrupted for thread spool replacement regardless of the type of sewing system applied, and thus, improvement in efficiency remains as a common goal among the foregoing systems.

SUMMARY

One object of the present disclosure is to provide a sewing system, a multi-needle sewing machine, a storage device, and a computer readable medium that provides improved work efficiency in a simple and low cost configuration.

In one aspect of the present disclosure, a sewing system includes a plurality of multi-needle sewing machines provided with a sewing mechanism including a plurality of needle bars, a transfer mechanism that transfers an embroidery frame that holds a workpiece cloth, and a plurality of thread spools associated with the needle bars; and a storage device that is detachably attached to the plurality of sewing machines and that stores embroidery pattern data including a plurality of thread color data, the sewing system being configured to sew an embroidery pattern made of a plurality colors of threads that exceeds maximum number thread colors that can be sewn by a single multi-needle sewing machine with a plurality of multi-needle sewing machines, wherein each of the plurality of multi-needle sewing machines further includes: a data reader that reads the embroidery pattern data from the storage device attached thereto, a thread spool color storage that stores thread color of the thread spools as thread spool color data, a verifier that verifies whether or not the thread color data contained in the embroidery pattern data read by the data reader matches the thread spool color data stored in the thread spool color storage, and a progress information writer that writes at least progress information pertaining to the thread color which was found not to match the thread color data contained in the embroidery pattern data by the verifier, and wherein the sewing system is configured to execute a sewing operation for forming the embroidery pattern on a workpiece cloth at one of the plurality of multi-needle sewing machines by: using a count of thread colors determined by a count of thread color data found to match the thread color data by the verifier, co-operating the sewing mechanism and the transfer mechanism, removing the storage device attached to the one of the plurality of multi-needle sewing machines and attaching the removed storage device to other one or more multi-needle sewing machines, and sewing unsewn portions of the embroidery pattern at each of the other one or more multi-needle sewing machines by: reading the progress information by the data reader, verifying whether or not the thread color data contained in the embroidery pattern data read by the data reader matches the thread spool color data stored in the thread spool color storage, and executing the sewing operation based on a result of the verification.

BRIEF DESCRIPTION OF THE DRAWINGS

Other objects, features and advantages of the present disclosure will become clear upon reviewing the following description of the illustrative aspects with reference to the accompanying drawings, in which.

FIG. 4 indicates one exemplary configuration of embroidery pattern data;

FIG. 6A is a descriptive view indicating one exemplary configuration of thread spool color data stored in a thread spool color storage of the first multi-needle sewing machine;

FIG. 6B is a descriptive view indicating one exemplary configuration of thread spool color data stored in a thread spool color storage of the second multi-needle sewing machine;

DESCRIPTION

One exemplary embodiment of sewing system S configured by multiple multi-needle embroidery sewing machines will be described hereinafter with reference to FIGS. 1 to 8B with an assumption that the direction in which the user positions himself/herself relative to the multi-needle embroidery sewing machine is the front.

Figure 1:
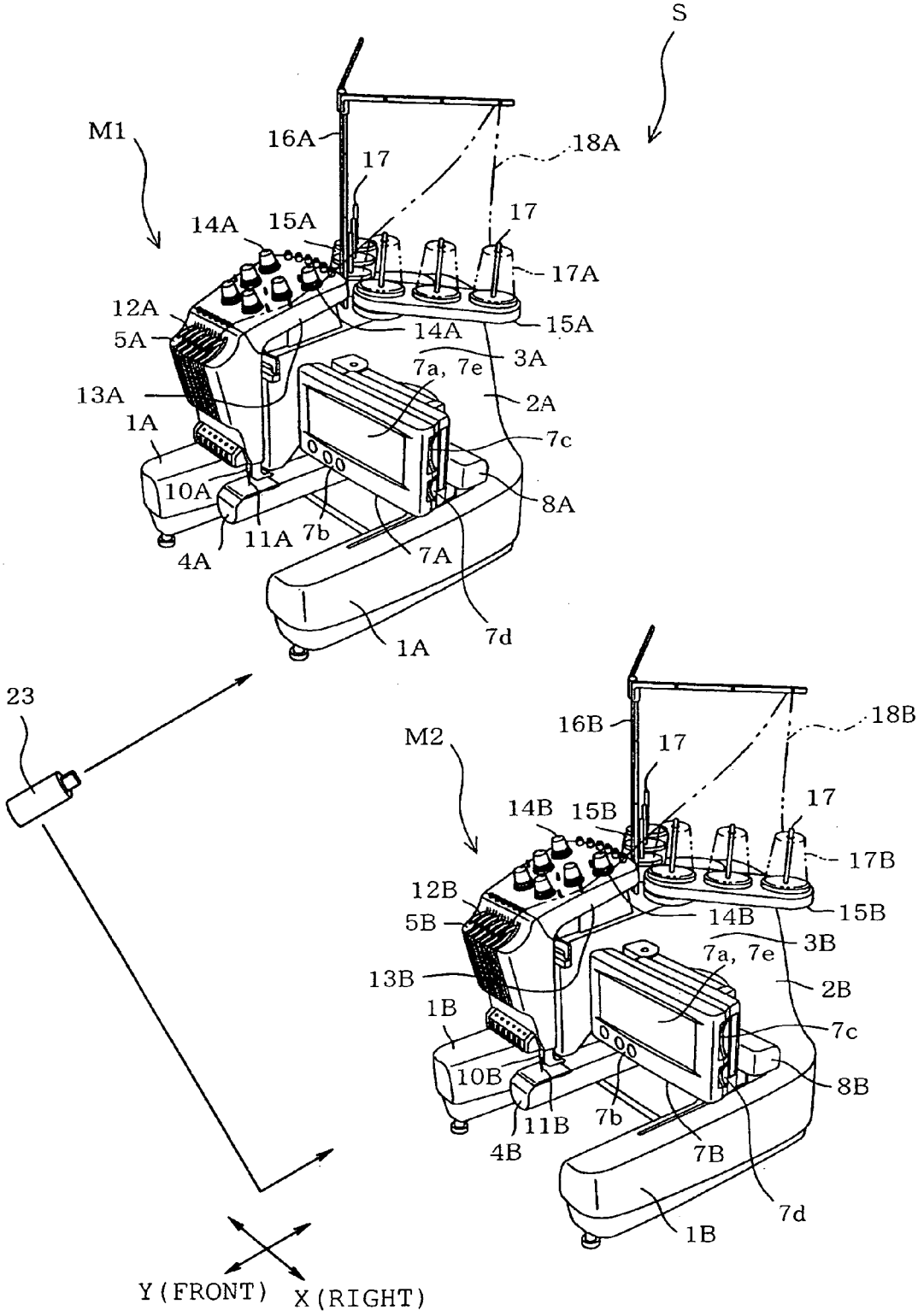
FIG. 1 is a schematic view of one exemplary embodiment of a sewing system.

Referring to FIG. 1, sewing system S, in one exemplary configuration, comprises a couple of multi-needle embroidery sewing machines hereinafter referred to as a first multi-needle sewing machine M1 and a second multi-needle embroidery sewing machine M2 and a storage device that is detachably attached to the first and second multi-needle sewing machines M1 and M2 respectively. One example of the storage device may be a later described USB (Universal Serial Bus) memory 23. The first and second multi-needle sewing machines M1 and M2 being substantially identical in configuration, will be described at once by appending an "A" after the reference symbols representing the elements of the first multi-needle sewing machine M1 and a "B" after the reference symbols representing the elements of the second multi-needle sewing machine M2.

As can be seen in FIG. 1, first and second multi-needle sewing machines M1 and M2 are provided with a pair of left and right feet 1A, 1B that support the sewing machines M1, M2 in their entirety, pillars 2A, 2B standing at the rear end of feet 1A, 1B, arms 3A, 3B extending forward from the upper portion of pillars 2A, 2B, cylinder beds 4A, 4B extending forward from the lower end of pillars 2A, 2B, and needle-bar cases 5A, 5B attached to the front ends of arms 3A, 3B. The first and second multi-needle sewing machines M1 and M2 are also provided with components such as controllers 6A, 6B shown in FIGS. 2A and 2B that are responsible for the overall control of multi-needle sewing machines M1, M2 and control panel 7A, 7B.

Figure 2A:
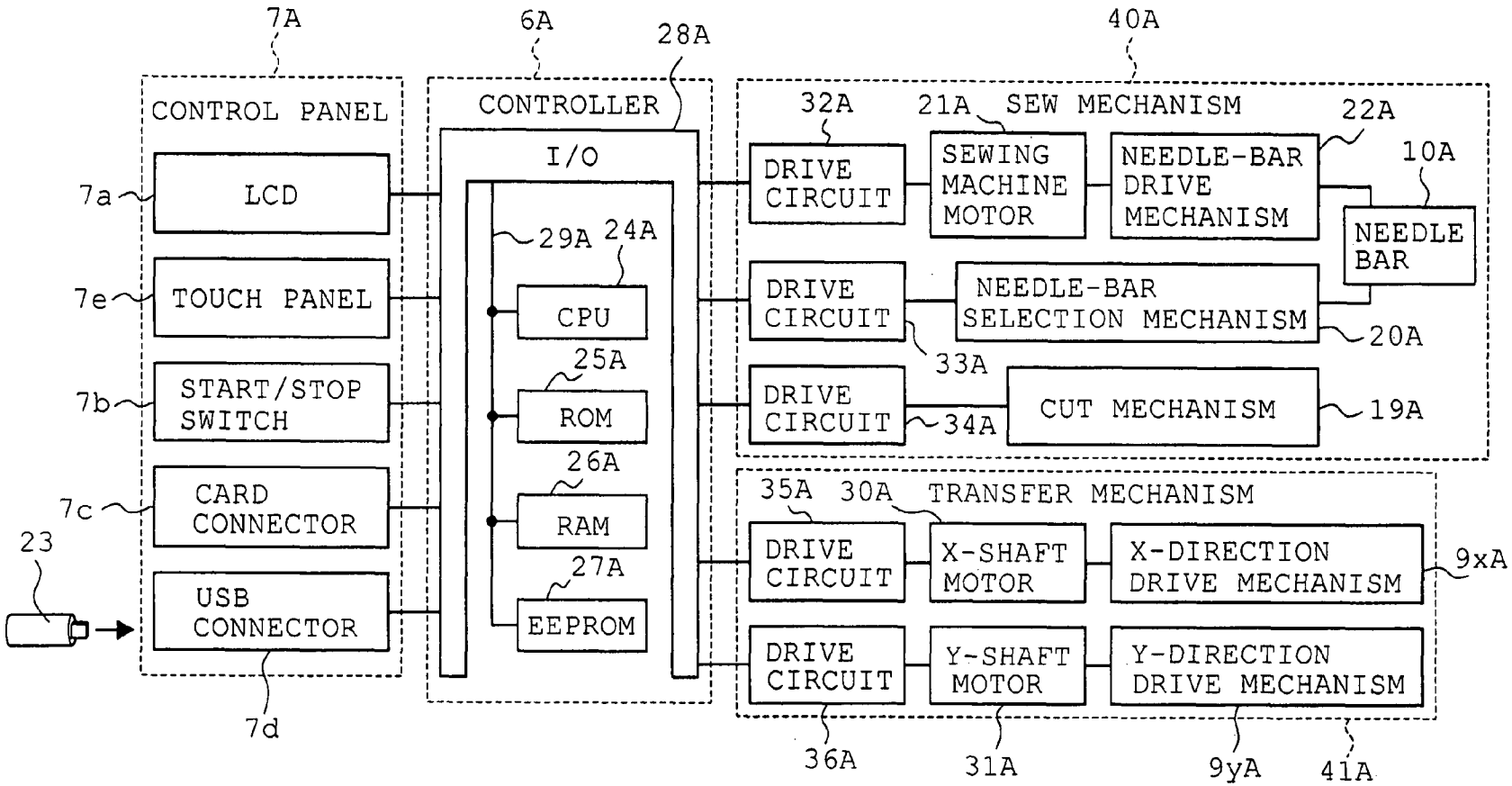
FIGS. 2A and 2B collectively represents a block diagram indicating an electrical configuration of the system.
Figure 2B:
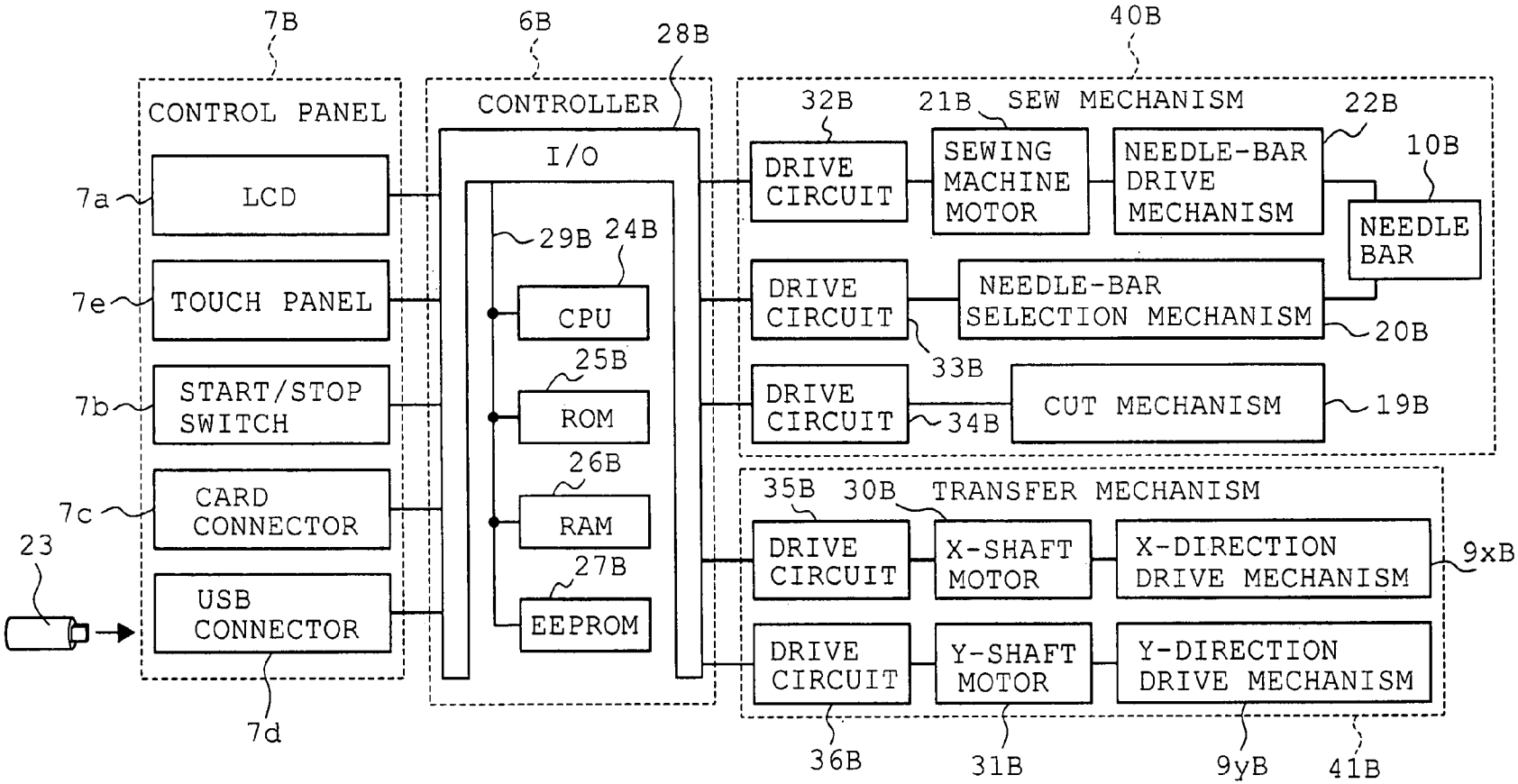

Above feet 1A, 1B, carriage 8A, 8B oriented in the left and right direction is disposed that contain X-drive mechanism 9xA, 9xB shown in FIGS. 2A and 2B respectively that drive frame mount base not shown provided in front of carriage 8A, 8B in the X direction or the left and right direction. Within the left and right feet 1A, 1B, Y-direction drive mechanism 9yA, 9yB shown in FIGS. 2A and 2B is provided that drives carriage 8A, 8B in the Y direction or the front and rear direction. X-drive mechanism 9xA, 9xB and Y-direction drive mechanism 9yA, 9yB are driven by a later described X-shaft motor 30A, 30B and Y-shaft motor 31A, 31B shown in FIGS. 2A and 2B respectively. The workpiece cloth not shown to be embroidered is held by a rectangular embroidery frame not shown which is mounted on the frame mount base. The embroidery frame being driven by the Y-direction drive mechanism 9yA, 9yB and the X-direction drive mechanism 9xA, 9xB is transferred in the Y direction in synchronism with carriage 8A, 8B or in the X direction along with the frame mount base, to allow the workpiece cloth to be fed.

Needle bar cases 5A, 5B support six vertically extending needle bars 10A, 10B, though only one is shown in FIG. 1, that are arranged side by side in the left and right direction. Needle bars 10A, 10B are allowed to move up and down and each of needle bars 10A, 10B has sewing needle 11A, 11B attached on its lower end. Needle bar case 5A, 5B are further provided with six thread take-ups 12A, 12B that are associated with the six needle bars 10A, 10B that are also allowed move up and down.

At the upper end of needle bar case 5A, 5B, a sloped thread tension regulator base 13A, 13B is fixed that is provided with six thread tension regulators 14A, 14B for making adjustments in thread tension. Behind thread tension regulator base 13A, 13B, a pair of left and right thread spool base 15A, 15B and thread guide mechanism 16A, 16B for preventing thread tangling are provided so as to be located on the rear side of the upper surface of arm 3A, 3B. Thread spool base 15A, 15B are provided with three thread pins 17 each being mounted with a thread spool 17A and 17B. The left and right pair of thread spool 15A, 15B allows placement of six thread spools 17A, 17B corresponding to six sewing needles 11A, 11B. Needle thread 18A, 18B extending from each of thread spools 17A, 17B provided on thread spool base 15A, 15B is supplied to the eye not shown of the corresponding sewing needle 11A, 11B by way of components such as the above described thread guide mechanism 16A, 16B, thread tension regulators 14A, 14B, and thread take-ups 12A, 12B. At the front end of cylinder bed 4A, 4B, thread cut mechanism 19A, 19B shown in FIGS. 2A and 2B is provided for cutting needle thread 18A, 18B and bobbin thread not shown.

Arm 3A, 3B contains needle-bar selection mechanism 20A, 20B shown in FIGS. 2A and 2B that transfers needle-bar case 5A, 5B in the X direction at the time of thread replacement. The transfer of needle-bar case 5A, 5B in the X direction causes one of the six pairs of needle bar 10A, 10B and thread take-ups 12A, 12B to be switched to the active position. The selected needle bar 10A, 10B and thread take-up 12A, 12B are moved up and down at the active position by being driven by sewing machine motor 21A, 21B shown in FIGS. 2A and 2B by way of needle-bar drive mechanism 22A, 22B shown in FIGS. 2A and 2B. Needle bar 10A, 10B, thread take-ups 12A, 12B, and a rotary shuttle not shown provided at the front end of cylinder bed 4A, 4B co-operate to form embroidery stitches on the workpiece cloth held by the embroidery frame.

Further, on the right side surface of arm 3A, 3B, a foldable control panel 7A, 7B is provided that is furnished with a laterally elongate liquid crystal display (LCD) 7*a* that displays later described progress information. On the lower front face of control panels 7A, 7B, switches such as start/stop switch 7*b* are provided, whereas on the side surface of control panel 7A, 7B, card connector 7*c* for inserting a memory card not shown storing various embroidery pattern data and USB memory connector 7*d* for detachable attachment of USB memory 23 are provided.

LCD 7*a* displays information such as information on the various embroidery patterns to be sewn, information on needle threads 18A, 18B set to needle bars 10A, 10B, information on sewing conditions such as thread tension and sewing speed, names of functionalities to be executed in the sewing operation, and various other information related to the sewing operation. Further, the front face of LCD 7*a* is provided with touch panel 7*e* comprising multiple touch keys composed of transparent electrodes. The user is allowed to execute various controls such as execution of various functionalities, specification of various sewing parameters, and specification of a later described thread replacement settings, through touch operation of the touch keys.

Sewing system S according to the present exemplary embodiment utilizes USB memory 23 for transferring information between the multiple sets, in this case, a couple of the first and second multi-needle sewing machines M1 and M2. Thus, embroidery patterns requiring thread color variations exceeding the maximum thread color variation available in a single multi-needle sewing machine M1 can be sewn with improved efficiency. The maximum thread color variation available in a single multi-needle sewing machine M1 in the present disclosure is six.

Figure 3:
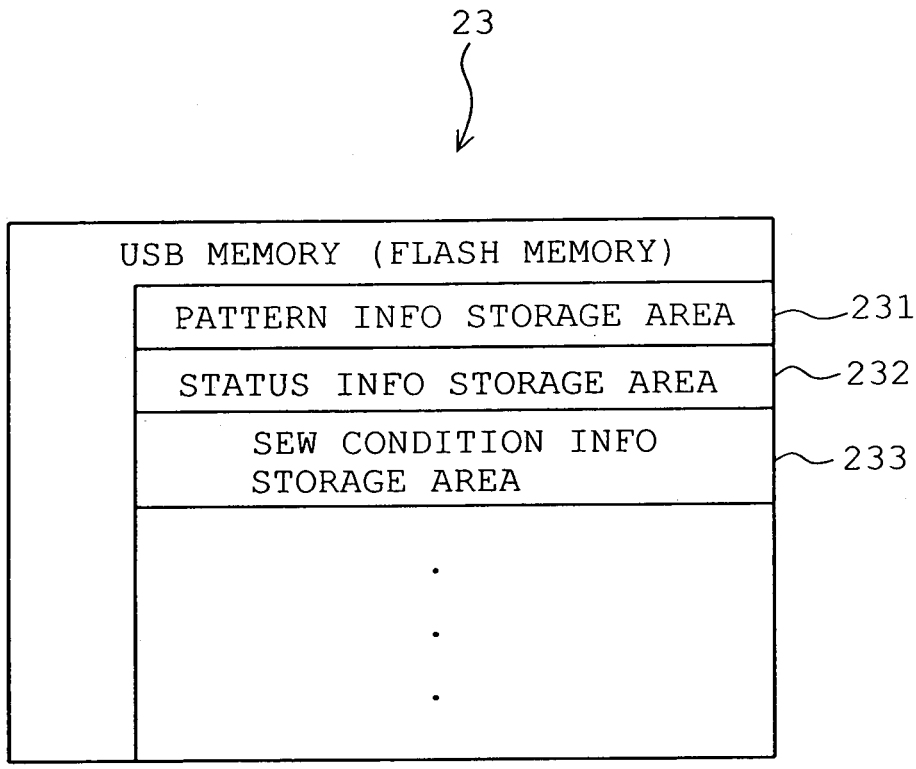
FIG. 3 is a descriptive view schematically illustrating the configuration of a storage area of a USB memory.

Next, a description will be given on USB memory 23 with reference to FIGS. 3 and 4.

USB memory 23 is a removable external storage device configured as a compact computer readable medium allowing writing and reading of data. USB memory 23, as described earlier, is disconnectably connected to USB port 7*d* by insertion. Information is exchanged between USB memory 23 and the first or the second multi-needle sewing machine by USB specification. As indicated in FIG. 3, USB memory 23 configured as a flash memory allocates storage areas such as pattern information storage area 231 for storing embroidery pattern data containing multiple thread colors, progress information storage area 232 for storing progress information pertaining to the thread color data, and more specifically, to the sewing sequence of a given thread color, and sewing condition information storage area 233 that stores information pertaining to sew conditions such as the sewing speed.

Referring to FIG. 4, the embroidery pattern data contains thread color data pertaining to multiple thread colors, 12 in the present disclosure; multiple entries of needle drop position data specified for each thread color; and thread color sequence data for determining the sewing sequence of thread colors 1 to 12. To elaborate, the uppermost thread color sequence data "thread color 1" in FIG. 4 identifies the first color to be sewn. The corresponding thread color, "pink" in this case, is actually represented for instance, by RGB. Further, needle drop position data "Xa0, Ya0" . . . "XaN, YaN" represents the coordinates in which the sewing needle carrying the "pink" thread is dropped in the specified sequence. Likewise, embroidery pattern data being second in the sewing sequence and beyond contain thread color sequence data "thread color 2" to "thread color 12", thread color data "yellow green" to "red", and needle drop position data "XbN, YbN" to "XlN, YlN". In generating the embroidery pattern data, known methods such as those described in JP 2001-259268 A, for example, may be employed.

USB memory 23 has the following information written to it in advance. For instance, the above described embroidery pattern data is written in pattern information storage area 231; and the sewing speed data that specifies the sewing speed appropriate for forming the stitches depending on the type of workpiece cloth, needle thread 18A, 18B, and bobbin thread etc., is written in the sewing condition information storage area 233. Sewing condition information storage 233 may contain needle thread tension levels specified as sewing condition instead. Progress information storage area 232, in its initialized state, contains thread color sequence data "thread color 1" which comes first in the sewing sequence.

Next, a description will be given on the control system of the first and second multi-needle sewing machines M1 and M2 with reference to the block diagram of FIGS. 2A and 2B. Controller 6A, 6B is configured primarily by a microcomputer and contains components such as CPU 24A, 24B; ROM 25A, 25B; RAM 26A, 26B; EEPROM 27A, 27B; input/output interface 28A, 28B also shown as I/O; and bus 29A, 29B interconnecting the foregoing components.

Input/output interface 28A, 28B establishes connections with drive circuits 32A, 32B; 33A, 33B; 34A, 34B; 35A, 35B; and 36A, 36B that drive sewing machine motor 21A, 21B; needle-bar selection mechanism 20A, 20B; cut mechanism 19A, 19B; X-shaft motor 30A, 30B; and Y-shaft motor 31A, 31B. Input/output interface 28A, 28B also establishes connection with LCD 7*a* provided at control panel 7A, 7B; start/switch 7*b*; card connector 7*c*; USB connector 7*d*; and touch panel 7*e*.

The above described components such as needle bar 10A, 10B; sewing needle 11A, 11B; the rotary shuttle, sewing machine motor 21A, 21B; needle-bar drive mechanism 22A, 22B; needle-bar selection mechanism 20A, 20B; cut mechanism 19A, 19B; drive circuits 32A, 32B, 33A, 33B, 34A, and 34B constitute one example of sewing mechanism 40A, 40B. Components for transferring the embroidery frame that holds the workpiece cloth such as Y-direction drive mechanism 9yA, 9yB; X-direction drive mechanism 9xA, 9xB; X-shaft motor 30A, 30B; and Y-shaft motor 31A, 31B; drive circuits 35A, 35B; and 36A, 36B constitute one example of transfer mechanism 41A, 41B. Controller 6A, 6B executes a series of sewing operation by co-operation of sewing mechanism 40A, 40B and transfer mechanism 41A, 41B through control of the above described actuators according to later described sewing control program, embroidery pattern data, etc.

ROM 25A, 25B stores items such as a sewing control program, a master thread information table containing all the information pertaining to the multiple types of thread used in embroidering including thread color data, thread mapping program that allows the user to associate the thread color data representing the thread colors of the needle threads 18A, 18B supplied from thread spools 17A, 17B with needle bars 10A, 10B, and display control program that controls LCD 7*a*, 7*b* of control panel 7A, 7B.

Figure 5A:
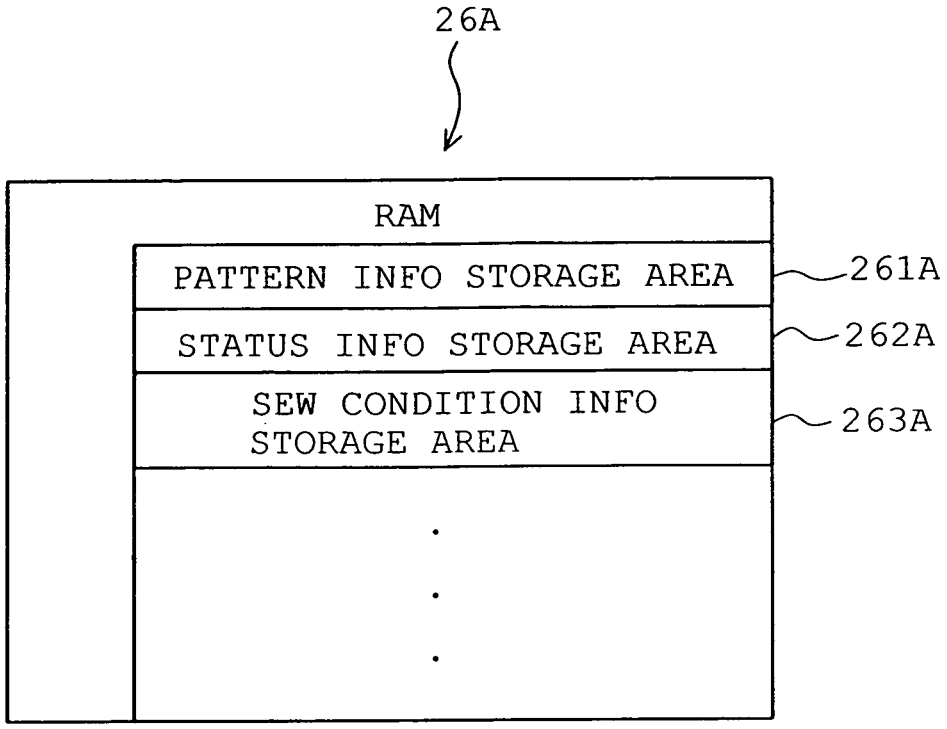
FIG. 5A is a descriptive view schematically illustrating the configuration of RAM of a first multi-needle sewing machine.
Figure 5B:
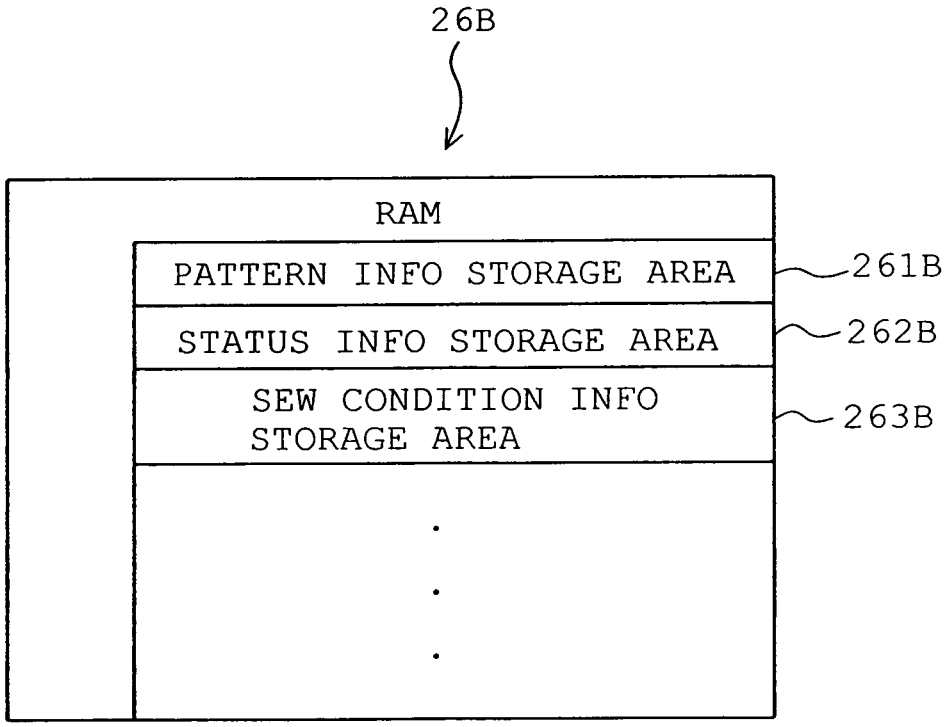
FIG. 5B is a descriptive view schematically illustrating the configuration of RAM of a second multi-needle sewing machine.

RAM 26A, 26B is provided with a storage area for temporary storage of various data. To elaborate, as indicated in FIG. 5A, RAM 26A allocates multiple storage areas such as pattern information storage area 261A for storing the thread color data and needle drop position data along with the thread color sequence data so as to be arranged in the order of their sewing sequence; progress information storage area 262A that stores information pertaining to the progress information, more specifically, to information pertaining to the sewing sequence of the thread color; and sewing condition information storage area 263A for storing information pertaining to sew conditions such as sewing speed. Likewise, as indicated in FIG. 5B, RAM 26B allocates multiple storage areas such as pattern information storage area 261B, progress information storage area 262B, and sewing condition information storage area 263B.

FIGS. 6A and 6B indicate one example of data configuration of thread spool color data stored in EEPROM 27A and EEPROM 27B of the first multi-needle sewing machine M1 and the second multi-needle sewing machine M2 respectively. To elaborate, the thread color data of the first multi-needle sewing machine M1 is configured such that needle bars 10A numbered from no. 1 to 6 in the order of their appearance from the right in front view are each associated with needle thread 18A colored in, for instance, pink, yellow green, green, gold, yellow, and black. The thread spool color data of thread spools 17A serving as the source of needle thread 18A is stored as thread spool color data in EEPROM 27A in mapping with the needle bar numbers. Likewise, the thread color data of the second multi-needle sewing machine M2 is configured such that needle bars 10B numbered from no. 1 to 6 in the order of their appearance from the right in front view are each associated with needle thread 18B colored in, for instance, blue, aqua blue, sky blue, brown, purple, and red. The thread spool color data of thread spools 17B serving as the source of needle thread 18B is stored as thread spool color data in EEPROM 27B in mapping with the needle bar numbers. The above described thread spool color data may be stored in EEPROM 27A, 27B through touch operation of touch panel 7*e*, for instance, for each needle bar number. Alternatively, a dedicated sensor capable of detecting the thread spool color data may be provided at each thread spool pin 17, etc., and thread spool color data detected by the sensor may be stored in EEPROM 27A and 27B, respectively.

Figure 7:
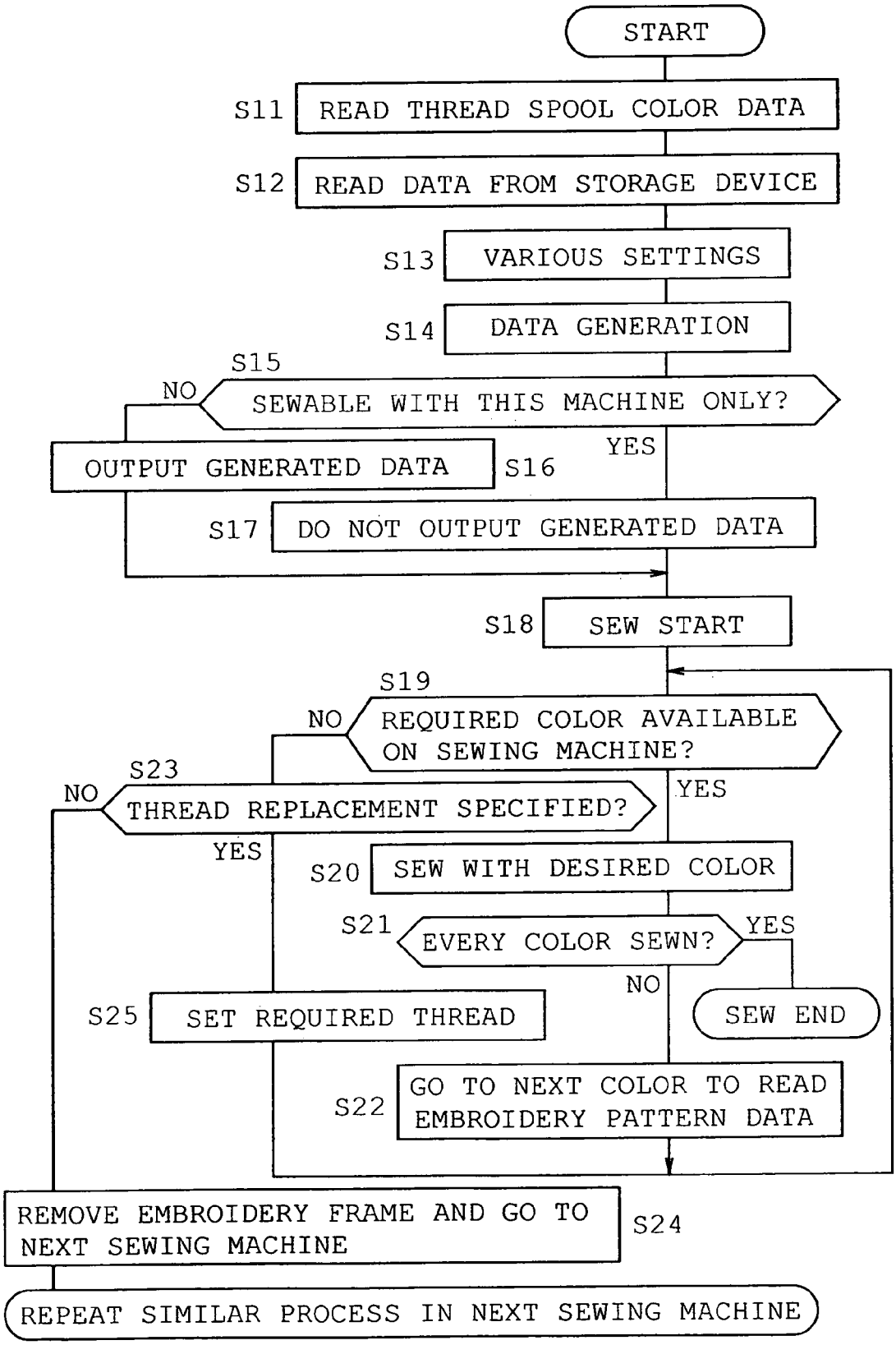
FIG. 7 is a flowchart of a sewing control executed at each of the multi-needle sewing machines.

Next, a description will be given, with reference to FIG. 7, on the process flow in sewing an embroidery pattern having 12 colors of thread to give an example of how the embroidery patterns with 7 or more colors of thread colors are sewn by the above described sewing system S. The present exemplary embodiment exemplifies the case where the system is configured by a couple of multi-needle sewing machines M1 and M2. The reference symbols Si . . . (i=11, 12, 13 . . . ) indicate each step of the process flow.

In sewing an embroidery pattern, the user is to attach USB memory 23 storing the data pertaining to the embroidery pattern to be sewn to USB port 7*d* of one of the multi-needle sewing machines, in this case, multi-needle sewing machine M1. Before initiating the sewing operation, thread spools 17A and 17B of the thread colors required in sewing the embroidery pattern further needs to be set on thread spool bases 15A and 15B of the first and second multi-needle sewing machines M1 and M2. Thus, thread spool color data for the 12 thread colors as indicated in FIGS. 6A, 6B is stored in EEPROMS 27A and 27B.

Then, using control panel 7A of the first multi-needle sewing machine M1, the user is to select the desired embroidery pattern from the selection of embroidery patterns presented on the pattern selection screen not shown displayed on LCD 7*a*. By selecting USB memory 23 as the source of data read through touch key operation, the following control is started.

As the first step of the control flow, controller 6A of the first multi-needle sewing machine M1 reads the thread spool color data for pink, yellow green, green, gold, yellow, and black indicated in FIG. 6A, for instance (step S11). Then, controller 6A reads embroidery pattern data from pattern information storage area 231 of USB memory 23 and stores it into pattern information storage area 261A of RAM 26A in the sequence described earlier (step S12). Controller 6A further reads thread color sequence data and sewing speed data stored in progress information storage area 232 and sewing condition information storage area 233 of USB memory 23 and stores them into progress information storage area 262A and sewing condition information storage area 263A, respectively. At this instance, progress information storage area 262A contains "thread color 1" as initial information.

Then, various parameter settings are executed for the read embroidery data (step S13). To elaborate, controller 6A displays thread replacement settings screen not shown on LCD 7*a* that contains items such as the presence/absence of thread replacement and the count of thread replacement. The user makes the settings pertaining to thread replacement through the settings screen by way of touch panel 7*e* operation. According to sewing system S of the present exemplary embodiment, when sewing embroidery patterns having 12 or more thread colors, thread replacement is executed by the user for the number of thread colors in excess of 12 colors. The procedures to be taken by the user will be later described. At the setting process of step S13, sewing sequence setting screen providing menus such as "rearrange sewing sequence" may be displayed on display 7*a* to allow settings for modifying the thread color sequence data to rearrange the sewing sequence on a color-by-color basis.

Then, controller 6A generates data for executing a sewing operation in accordance with the settings made at step S13 based on the read thread spool color data and thread color data of embroidery pattern data. The embroidery pattern data of the first multi-needle sewing machine M1 is finalized according to the preset or edited sewing sequence (step S14).

Then, controller 6A determines whether or not the thread color data present in the embroidery pattern data matches the read thread spool color data (step S15). In other words, controller 6A executes a verification process to verify that all the required thread colors required in sewing the embroidery pattern is available at the first multi-needle sewing machine M1. If it is found in the verification process that not all the required thread color data is available (step S15: No), controller 6A at least writes the progress information pertaining to the absent thread color data, which is yet to be sewn, of the embroidery pattern data into USB memory 23 (step S16). One exemplary mode of the above described data writing may be overwriting, in other words, rewriting after initializing the currently populated information, to store the embroidery pattern data generated at step S14 into pattern information storage area 231 of USB 23 as the progress information. This overwriting further stores thread color sequence data "thread color 7" which is the initially sewn thread color at the second multi-needle sewing machine M2 into progress information storage area 232 of USB memory 23 as progress information. Stated differently, thread color sequence data of "thread color 7" indicates the thread color sequence data which is the next in the sewing sequence to the lastly sewn thread color sequence data of the first multi-needle sewing machine M1.

If all the required thread color data for sewing the embroidery pattern is available at the first multi-needle sewing machine M1 to allow the sewing operation to be executed at the first multi-needle sewing machine M1 alone (step S15: Yes), no information is written into USB memory 23 (step S17). As will be described in detail afterwards, controller 6A is configured to display the embroidery pattern to LCD 7*a* based on embroidery pattern data prior to starting the sewing operation at step S18.

As described above, at the first multi-needle sewing machine M1, RAM 26A is initialized with "thread color 1" while the progress information pertaining to the portion which cannot be sewn is stored as progress information into USB memory 23 prior to the start of the sewing operation. Thus, USB memory 23 can be removed from the first multi-needle sewing machine M1 prior to the start of the sewing operation of the first multi-needle sewing machine M1 and be attached to the second multi-needle sewing machine M2. This means that the preparatory work can be carried out at the second multi-needle sewing machine M2 while executing the sewing operation of step S18 onwards at the first multi-needle sewing machine M1.

The sewing operation at the first multi-needle sewing machine M1 is started by the operation of start/stop switch 7*b* of control panel 7A (step S18). The sewing operation is executed based on various information such as the embroidery pattern data, the progress information, and the sewing speed data. Taking the example of a sewing operation executed based on the embroidery pattern data indicated in FIG. 4, controller 6A initially refers "thread color 1" stored in progress information storage area 262A of RAM 26A. Then, controller 6A proceeds to read thread color data of "pink" corresponding to "thread color 1" of the embroidery pattern data stored in pattern information storage area 261A and further refers to the thread spool color data indicated in FIG. 6A. Controller 6A, when determining that thread spool color data for "pink" is available (step S19: Yes), selects needle bar 10A associated with the "pink" thread spool color data and proceeds to control transfer mechanism 41A based on needle drop position data "Xa0, Ya0, . . . ". Thus, series of sewing operation on the workpiece cloth in pink thread color is executed at the first multi-needle sewing machine M1 by the co-operation of sewing mechanism 40A and transfer mechanism 41A (step S20).

Then, controller 6A further proceeds to determine whether or not sewing of the embroidery pattern has been fully completed at the first multi-needle sewing machine M1 (step S21). In this example, "thread color 2" onwards of thread color sequence data is yet to be processed (step S21 No). Thus, according to the thread color sequence data, "yellow green" corresponding to "thread color 2" repeats the process carried out for "thread color 1" (steps S22 and S19). By repeating steps S19, S20, S21, and S22 according to the sequence of the thread color sequence data, sewing of "pink" corresponding to "thread color 1" to "black" corresponding to "thread color 6" is carried out on a color-by-color basis for the six colors. Then, after sewing all six colors, controller 6A determines that no thread spool color data is available at step S19 and further proceeds to determine whether or not thread replacement has been set (step S23). In this respect, in sewing embroidery pattern having 12 thread colors, the setting of thread replacement at step S13 is not required (step S23: No). After sewing the six thread colors at the first multi-needle sewing machine M1, the embroidery frame holding the workpiece cloth is removed from the first multi-needle sewing machine M1 and attached to the second multi-needle sewing machine M2 (step S24).

In sewing an embroidery pattern having 14 thread colors, for instance, thread replacement count etc., to render the thread replacement of the two extra thread colors can be set at step S13 at the first multi-needle sewing machine M1 in order to enable the completion of the embroidering by the couple of multi-needle sewing machines M1 and M2. In this case, controller 6A determines that thread replacement has been set at S23 and temporarily stops the sewing operation of the first multi-needle sewing machine M1 at step S25. The user is to replace the threads during the interruption. Thus, steps S23, S25, S19, S20, S21, and S22 are repeated until the specified count of thread replacement is completed (step S23: No). Thread replacement may be set at the second multi-needle sewing machine M2 and in such case, all of the sewing operation at the first multi-needle sewing machine M1 is completed at step S21.

Next, a description will be given on the sewing control executed by controller 6B at the second multi-needle sewing machine. The user is to attach USB memory 23 having been stored with the progress information by the first multi-needle sewing machine M1 to USB port 7*d* of the second multi-needle sewing machine M2. Then, as done in the first multi-needle sewing machine M1, by selecting USB memory 23 as the source of data read through touch key operation not shown at the pattern selection screen displayed on operation panel 7B, the following control is started. As described earlier, the first and the second multi-needle sewing machines M1 and M2 are basically identical in configuration except for the portions related to thread colors of thread spools 17A and 17B and thus, the sew control of controller 6B will be described with reference to FIG. 7.

Figure 8A:
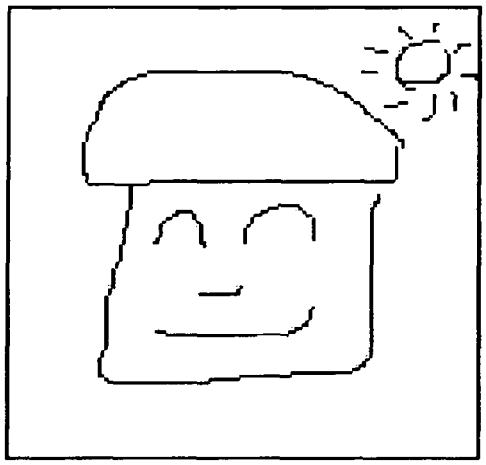
FIG. 8A is a simplified illustration of how the entire embroidery pattern is displayed on a liquid crystal display.
Figure 8B:
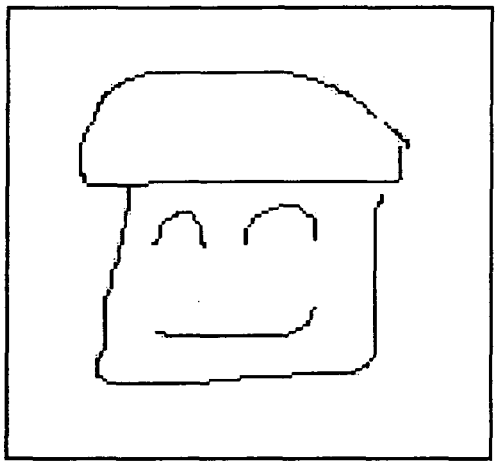
FIG. 8B is a simplified illustration of how the sewn portions of the embroidery pattern are displayed on the liquid crystal display based on progress information.

Controller 6B of the second multi-needle sewing machine M2 reads the thread spool color data set in EEPROM 27B for blue, aqua blue, sky blue, brown, purple, and red indicated in FIG. 6B, for instance (step S11). Then, controller 6B reads information such as embroidery pattern data, thread color sequence data, and sew speed data from each of storage areas 231 to 233 of USB memory 23 and stores them into each of storage areas 261B to 263B of RAM 26B (step S12). At this instance, progress information storage area 262B contains "thread color 7" as the initially sewn thread color sequence data. Then, controller 6B displays the finished image of the embroidery pattern as illustrated in FIG. 8A and the current image of the embroidery pattern illustrated in FIG. 8B after having sewn six thread colors on LCD 7*b* based on the embroidery pattern data and progress information. This allows the user to compare the two images of the embroidery pattern displayed on LCD 7*b* with the actual embroidery pattern having been sewn on the workpiece cloth of the second multi-needle sewing machine M2. Thus, the user is given the opportunity to verify whether the sewing operation is progressing as intended and whether any mechanical errors have occurred such as misplacement of the embroidery frame and USB memory 23, etc.

Then, as done in the first multi-needle sewing machine M1, various parameter settings are executed for the read embroidery data (step S13). Then, controller 6B generates data for executing a sewing operation in accordance with the settings made at step S13 based on the thread spool color data and the thread color data of embroidery pattern data (step S14). Then, controller 6B executes a verification process that determines whether or not the thread color data present in the embroidery pattern data matches with the read thread spool color data (step S15). If determined that all the required thread colors required in sewing the embroidery pattern is not available at the second multi-needle sewing machine M2 (step S15: No), controller 6B writes the earlier mentioned thread color sequence data and embroidery pattern data generated at step S14 into each of the storage areas of USB memory 23 (step S16). If the verification process finds that all the required thread color data for sewing the embroidery pattern is available at the second multi-needle sewing machine M2 to allow the sewing operation to be executed at the second multi-needle sewing machine M2 alone (step S15: Yes), no information is written into USB memory 23 (step S17). That is, in sewing an embroidery pattern that has 12 thread colors, if it is found that all 6 thread colors required in sewing the remaining unsewn portions are available at the second multi-needle sewing machine M2, the sewing operation can be completed by the second multi-needle sewing machine M2 alone. Thus, controller 6B initializes the thread color sequence data stored in progress information storage area 232 of USB memory 23 and writes the thread color sequence data "thread color 1".

The sewing operation at the second multi-needle sewing machine M2 is started by the operation of start/stop switch 7*b* of control panel 7B (step S18) based on various information stored in each of storage areas 261B to 263B stored in RAM 26B. Taking the example of the case where sewing sequence of the unsewn thread color data of embroidery pattern data are set according to the sequence of the needle bars indicated in FIG. 6B, controller 6B initially refers "thread color 7" stored in progress information storage area 262B. Then, controller 6B proceeds to read thread color data of "blue" corresponding to "thread color 7" of the embroidery pattern data stored in pattern information storage area 261B and further refers to the thread spool color data indicated in FIG. 6B. Controller 6B, when determining that thread spool color data for "blue" is available (step S19: Yes), selects needle bar 10B associated with the "blue" thread spool color data and proceeds to control transfer mechanism 41B based on needle drop position data. Thus, series of sewing operation on the workpiece cloth in blue thread color is executed at the second multi-needle sewing machine M2 by the co-operation of sewing mechanism 40B and transfer mechanism 41B (step S20).

Then, controller 6B further proceeds to determine whether or not sewing of the embroidery pattern has been fully completed at the second multi-needle sewing machine M2 (step S21). In this example, "thread color 8" onwards of thread color sequence data is yet to be processed (step S21 No). Thus, according to the thread color sequence data, "aqua blue" corresponding to "thread color 8" repeats the process carried out for "thread color 7" (steps S22 and S19). By repeating steps S19, S20, S21, and S22 according to the sequence of the thread color sequence data, sewing of "blue" corresponding to "thread color 7" to "red" corresponding to "thread color 12" is carried out on a color-by-color basis for the six colors. Thus, sewing of unsewn portion by the six thread colors is completed (step S21: Yes) to complete the sewing operation by the entire sewing system S.

The sewing operation carried out by each of multi-needle sewing machines M1 and M2 according to the above described exemplary embodiment pursues two different courses of actions depending upon whether or not the progress information stored in USB memory 23 contains the thread color data of the thread color that was found to be unavailable as the result of the verification process. Stated differently, if USB memory 23 does not contain the progress information, multi-needle sewing machines M1 and M2 uses the count of thread colors that have been determined to be available as the result of verification process to execute the sewing operation to form the embroidery pattern on the workpiece cloth. if USB memory 23 does contain the progress information, multi-needle sewing machines M1 and M2 verify the thread color data of the progress information with the thread spool color data of EEPROM 27A and 27B and executes the sewing operation based on the result of verification to sew the unsewn portions of the embroidery pattern.

According to sewing system S, in sewing embroidery patterns that exceed the number of thread colors that can be sewn by a single multi-needle sewing machine, multi-needle sewing machine M1, for instance, multi-needle sewing machine M1 executes the sewing operation for the count of thread colors that it is capable of sewing based on the embroidery pattern data stored in USB memory 23 attached to it. USB memory 23, after being stored with the progress information at multi-needle sewing machine M1, is removed and attached to the subsequent sewing machine, in this case, multi-needle sewing machine M2. The portion of the embroidery pattern unsewn by multi-needle sewing machine M1 can be sewn by the subsequent multi-needle sewing machine M2 by reading the progress information. Thus, embroidery patterns can be sewn that exceeds the count of thread colors by simply using USB memory 23 as the storage device without having to provide separate components such as tag reader/writers as those described in aforementioned examples. Thus, complexity and cost in configuring sewing system S can be minimized as well as eliminating the trouble some task of thread spool replacement even when sewing patterns having 12 thread colors to obtain improved work efficiency.

Controller 6A, 6B is configured to write progress information into USB memory 23 prior to execution of the sewing operation at each of multi-needle sewing machines M1 and M2. Thus, USB memory 23 can be removed from the multi-needle sewing machines M1 or M2 in operation and be attached to the subsequent multi-needle sewing machine. Thus, while one multi-needle sewing machine is in operation, preparatory work for execution of sewing operation at the subsequent multi-needle can be executed at the same time to execute the sewing work with improved efficiency. Writing of the progress information into USB memory 23 may be executed while the sewing operation is ongoing at both the first and the second multi-needle embroidery sewing machines M1 and M2. Alternatively, though disadvantageous in terms of efficiency, the progress information may be written to USB memory 23 when the sewing operation has been completed.

Multi-needle sewing machine M1, M2 is provided with control panel 7A, 7B for displaying the progress information. This is useful when, for instance, the embroidery frame holding the workpiece cloth and USB memory 23 are set to the subsequent sewing machine M2 to sew the unsewn portions of the embroidery pattern. That is, the above described arrangement allows the user to compare the images of the embroidery pattern displayed on LCD 7*b* of control panel 7B and the actual embroidery stitches of the embroidery pattern formed on the workpiece cloth. Thus, the unsewn portions of the embroidery pattern can be visually recognized by the user with ease while preventing attachment of components such as USB memory 23 and the embroidery frame.

USB memory 23 differs from the wireless tags used in the related examples that perform non-contact data exchange, in that it is configured as a removable medium that allows data to be written to and read from it. By employing a compact and portable computer readable medium such as USB memory 23, data can be readily exchanged between multi-needle sewing machines M1 and M2 as well as providing sewing system S with low cost and low complexity.

Sewing system S is not limited to a system configured by a couple of multi-needle sewing machines M1 and M2 but may be configured by three or more multi-needle sewing machines. In such configuration also, the progress information is exchanged between the multiple multi-needle sewing machines by using storage devices such as USB memory 23 only, thereby minimizing the need of accessories or additional features to the multi-needle sewing machines to improve the work efficiency.

The storage device is not limited to USB memory 23 but may come in the form of CD-ROM, flexible disk, DVD, flash memory and other computer readable medium. Such alternative medium may be read and executed by controllers 6A and 6B of the multi-needle sewing machines M1 and M2 respectively to obtain operation and effect similar to those provided in the foregoing embodiment.

The count or number of thread colors that can be sewn by a single multi-needle sewing machine, in other words, the count of needle bars, or the like, may be modified as required to be greater or less than six, and hence the sewing system may be configured by different types of multi-needle sewing machines.

The medium for storing the control programs is not limited to ROM 25A, 25B of controller 6A, 6B but may come in the form of medium such as CD-ROM, flexible disk, DVD, flash memory and other mediums. Such alternative medium may be read and executed by controllers 6A and 6B of the multi-needle sewing machines M1 and M2 respectively to obtain operation and effect similar to those provided in the foregoing embodiment.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A sewing system comprising:

a plurality of multi-needle sewing machines provided with a sewing mechanism including a plurality of needle bars, a transfer mechanism that transfers an embroidery frame that holds a workpiece cloth, and a plurality of thread spools associated with the needle bars; and a storage device that is detachably attached to the plurality of sewing machines and that stores embroidery pattern data including a plurality of thread color data, the sewing system being configured to sew an embroidery pattern made of a plurality colors of threads that exceeds maximum number thread colors that can be sewn by a single multi-needle sewing machine with a plurality of multi-needle sewing machines, wherein each of the plurality of multi-needle sewing machines further includes:

a data reader that reads the embroidery pattern data from the storage device attached thereto, a thread spool color storage that stores thread color of the thread spools as thread spool color data, a verifier that verifies whether or not the thread color data contained in the embroidery pattern data read by the data reader matches the thread spool color data stored in the thread spool color storage, and a progress information writer that writes at least progress information pertaining to the thread color which was found not to match the thread color data contained in the embroidery pattern data by the verifier, and wherein the sewing system is configured to execute a sewing operation for forming the embroidery pattern on a workpiece cloth at one of the plurality of multi-needle sewing machines by:

using a count of thread colors determined by a count of thread color data found to match the thread color data by the verifier, co-operating the sewing mechanism and the transfer mechanism, removing the storage device attached to the one of the plurality of multi-needle sewing machines and attaching the removed storage device to other one or more multi-needle sewing machines, and sewing unsewn portions of the embroidery pattern at each of the other one or more multi-needle sewing machines by:

reading the progress information by the data reader, verifying whether or not the thread color data contained in the embroidery pattern data read by the data reader matches the thread spool color data stored in the thread spool color storage, and executing the sewing operation based on a result of the verification.

2. The system according to claim 1, wherein the progress information writer writes the progress information to the storage device prior to execution of the sewing operation by the multi-needle sewing machine.

3. The system according to claim 1, wherein the multi-needle sewing machine further includes a display that displays the progress information.

4. The system according to claim 1, wherein the storage device comprises a storage medium that allows data to be written thereto and read therefrom.

5. A storage device for use in the sewing system according to claim 1 being detachably attached to the multi-needle sewing machine.

6. A multi-needle sewing machine that allows detachable attachment of a storage device for storing embroidery pattern data including a plurality of thread color data, the multi-needle sewing machine being provided with a sewing mechanism including a plurality of needle bars, a transfer mechanism that transfers an embroidery frame for holding a workpiece cloth to execute an embroidery sewing operation for forming an embroidery pattern on the workpiece cloth by the co-operation of the sewing mechanism and the transfer mechanism based on the embroidery pattern data, and a plurality of thread spools associated with the needle bars, the multi-needle sewing machine comprising:

a data reader that reads the embroidery pattern data from the attached storage device, a thread spool color storage that stores thread color of the thread spools as thread spool color data, a verifier that verifies whether or not the thread color data contained in the embroidery pattern data read by the data reader matches the thread spool color data stored in the thread spool color storage, and a progress information writer that writes at least progress information pertaining to the thread color which was found not to match the thread color data contained in the embroidery pattern data by the verifier, wherein the multi-needle sewing machine, when the progress information is not written in the storage device, executes a sewing operation that forms the embroidery pattern on the workpiece cloth using a count of thread colors determined by a count of thread color data found to match the thread color data by the verifier, whereas when the progress information is written in the storage device, sews unsewn portions of the embroidery pattern by:

reading the progress information by the data reader, verifying whether or not the thread color data contained in the progress information read by the data reader matches the thread spool color data stored in the thread spool color storage, and executing the sewing operation based on a result of the verification.

7. The multi-needle sewing machine according to claim 6, wherein the progress information writer writes the progress information to the storage device prior to execution of the sewing operation by the multi-needle sewing machine.

8. The multi-needle sewing machine according to claim 6, further comprising a display that displays the progress information.

9. The multi-needle sewing machine according to claim 6, wherein the storage device comprises a storage medium that allows data to be written thereto and read therefrom.

10. A storage device for use in the multi-needle sewing machine according to claim 6 being detachably attached to the multi-needle sewing machine.

11. A computer readable medium for use in a sewing system including a plurality of multi-needle sewing machines provided with a detachable storage device that stores embroidery pattern data that contains a plurality of thread color data, a sewing mechanism including a plurality of needle bars and a transfer mechanism that transfers an embroidery frame that holds a workpiece cloth and a plurality of thread spools associated with the plurality of needle bars; the sewing system being configured to sew an embroidery pattern made of a plurality colors of threads that exceeds maximum number thread colors that can be sewn by a single multi-needle sewing machine on the workpiece cloth with a plurality of multi-needle sewing machines by co-operating the sewing mechanism and the transfer mechanism, the computer readable medium storing a control program for executing a sewing operation that forms the embroidery pattern on a workpiece cloth, the control program comprising:

instructions for reading the embroidery pattern data from the attached storage device;

instructions for verifying whether or not the thread color data contained in the embroidery pattern data read by the data reader matches thread spool color data stored in a thread spool color storage, and instructions for writing at least progress information pertaining to the thread color which was found not to match the thread color data contained in the embroidery pattern data by the verifier, and instructions for, when the progress information is not written in the storage device, executing a sewing operation that forms the embroidery pattern on the workpiece cloth using a count of thread colors determined by a count of thread color data found to match the thread color data by the verification, whereas when the progress information is written in the storage device, sewing unsewn portions of the embroidery pattern by:

reading the progress information by the data reader, verifying whether or not the thread color data contained in the progress information read by the data reader matches the thread spool color data stored in the thread spool color storage, and executing the sewing operation based on a result of the verification.

12. The computer readable medium according to claim 11, wherein the progress information is written in the storage device prior to execution of the sewing operation.

* * * * *